US010544795B2

(12) United States Patent
Dirks et al.

(10) Patent No.: US 10,544,795 B2
(45) Date of Patent: Jan. 28, 2020

(54) SELF-PRIMING PUMP

(71) Applicant: GEA Tuchenhagen GmbH, Büchen (DE)

(72) Inventors: Stephan Dirks, Hamburg (DE); Markus Pawlik, Büchen (DE)

(73) Assignee: GEA Tuchenhagen GmbH, Büchen (DE)

( * ) Notice: Subject to any disclaimer, the term of this patent is extended or adjusted under 35 U.S.C. 154(b) by 66 days.

(21) Appl. No.: 15/557,638

(22) PCT Filed: Mar. 11, 2016

(86) PCT No.: PCT/EP2016/055283
§ 371 (c)(1),
(2) Date: Sep. 12, 2017

(87) PCT Pub. No.: WO2016/146523
PCT Pub. Date: Sep. 22, 2016

(65) Prior Publication Data

US 2018/0058466 A1 Mar. 1, 2018

(30) Foreign Application Priority Data

Mar. 13, 2015 (DE) ..... 10 2015 003 224

(51) Int. Cl.
*F04D 29/22* (2006.01)
*F04D 1/06* (2006.01)
(Continued)

(52) U.S. Cl.
CPC ..... *F04D 29/2277* (2013.01); *F04D 1/06* (2013.01); *F04D 3/02* (2013.01); *F04D 9/02* (2013.01);
(Continued)

(58) Field of Classification Search
CPC ..... F04D 29/2277; F04D 29/043; F04D 3/02; F04D 29/62; F04D 1/06; F04D 9/041; F04D 9/04; F04D 9/02
See application file for complete search history.

(56) References Cited

U.S. PATENT DOCUMENTS 3,082,694 A * 3/1963 Brkich ..... F04D 9/041 417/199.2
3,381,621 A * 5/1968 Luhmann ..... F04D 9/041 415/203
(Continued)

FOREIGN PATENT DOCUMENTS

DE 19918286 A1 10/2000
DE 202004013752 U1 12/2004
(Continued)

*Primary Examiner* — Joseph J Dallo
(74) *Attorney, Agent, or Firm* — Young Basile Hanlon & MacFarlane, P.C.

(57) ABSTRACT

A self-priming pump is described that has a housing, an inlet, and an outlet. A first impeller has a first pump section that is arranged in a first chamber, and a second impeller has a second pump section that is arranged in a second chamber. A shaft section is provided between the pump sections, and has a shaft end and penetrates an opening in a housing wall. To improve the net positive section head of the pump, the shaft section between a constriction and the shaft end is formed to taper from the shaft end toward the constriction, and the first impeller and shaft section between the constriction and first pump section has a smooth contour.

20 Claims, 4 Drawing Sheets

(51) Int. Cl.

| | |
|---|---|
| ***F04D 9/02*** | (2006.01) |
| ***F04D 9/04*** | (2006.01) |
| ***F04D 29/62*** | (2006.01) |
| ***F04D 3/02*** | (2006.01) |
| ***F04D 29/043*** | (2006.01) |

(52) U.S. Cl.
CPC ..... *F04D 9/04* (2013.01); *F04D 9/041* (2013.01); *F04D 29/043* (2013.01); *F04D 29/62* (2013.01)

(56) References Cited

U.S. PATENT DOCUMENTS 4,523,893 A * 6/1985 Johst ..... F04C 19/00 417/68
5,599,171 A * 2/1997 Horwitz ..... F04C 5/00 415/143
6,152,689 A * 11/2000 Yokota ..... F04D 7/045 415/143
6,585,493 B2 * 7/2003 Sutton ..... F04D 9/041 417/199.2
7,121,813 B2 * 10/2006 Choi ..... F04D 27/0292 417/279
7,287,963 B2 * 10/2007 Basora ..... F04D 9/001 417/199.2
7,331,770 B2 * 2/2008 Oyaski ..... A61M 5/14212 417/201
7,597,732 B2 * 10/2009 Yokota ..... B01D 19/0052 55/406
8,998,586 B2 * 4/2015 Muhs ..... F04D 9/041 417/199.2
9,587,641 B2 * 3/2017 Mettler ..... F04D 17/08
2002/0034446 A1 * 3/2002 Sutton ..... F04D 9/041 417/199.2
2013/0320148 A1 12/2013 Lewis

FOREIGN PATENT DOCUMENTS

| | | | |
|---|---|---|---|
| DE | 102007032228 | A1 | 1/2009 |
| DE | 102011106525 | A1 | 1/2013 |
| EP | 1191228 | A2 | 3/2002 |
| EP | 2894342 | A1 | 7/2015 |
| WO | 2015104137 | A1 | 7/2015 |

* cited by examiner

SELF-PRIMING PUMP

TECHNICAL FIELD

The invention relates to a self-priming pump.

BACKGROUND

Self-priming pumps are known in the prior art and have been used for many years successfully in the processing industry. In this context, the processing industry means in particular the beverage industry, food industry, pharmaceuticals and biochemistry.

Such pumps are for example designed as self-priming rotary pumps. A first chamber and second chamber in each of which an impeller is arranged can be provided between the inlet and the outlet of such a rotary pump. Each impeller is part of a pump stage, wherein the pump stage closer to the inlet generates the self-priming feature.

A first self-priming rotary pump of this kind is proposed in EP 1 191 228 A2. Another self-priming pump is described in DE 10 2007 032 228 A1.

In addition to the rotary pump stage, these two rotary pumps possess a liquid ring pump stage that receives the fluid to be pumped directly from the inlet of the rotary pump. With the assistance of the liquid ring pump stage, an underpres sure can be generated that draws the liquid from the line connected to the inlet.

A return line connects the overpressure region of the rotary pump stage to the inlet of the liquid ring pump stage. This ensures a liquid reservoir, which is needed when starting the rotary pump to generate the liquid ring.

The impeller of the rotary pump stage is connected to the impeller of the liquid ring pump stage via a shaft section that penetrates an opening in a housing wall. In both cases, the shaft section is designed cylindrically up to its shaft end facing the impeller of the rotary pump.

An important parameter of such self-priming rotary pumps is the NPSH value. NPSH stands for "net positive suction head" and is frequently equated with the term "maintained pressure level". This parameter indicates the overpressure of the fluid to be pumped at the inlet of the pump that must predominate about the vapor pressure of this fluid in order to prevent cavitation in the pump interior. This increased pressure must be generated in the processing system. A pump is therefore sought that has the lowest possible NPSH value.

BRIEF SUMMARY

It is accordingly the object of the invention to present a self-priming pump with an improved net positive suction head.

The self-priming pump has a housing with an inlet and an outlet. A first impeller possesses a first pump section that is arranged in a first chamber. A second impeller bears a second pump section that is arranged in a second chamber. Between the pump sections, a shaft section is provided, which shaft section comprises a shaft end and penetrates an opening in a housing wall. The flow of the fluid to be pumped, in particular a liquid with gas components, along the shaft section is improved in that the shaft section between a constriction and the shaft end is formed to taper from the shaft end to the constriction, and the first impeller and shaft section between the constriction and the first pump section has a smooth contour.

A smooth contour within the meaning of this text is a surface shape of the shaft section and the impeller in which steps, kinks, ledges and similar structures are designed and their number is minimized to reduce swirling in the fluid flowing by to a minimum, or to an indiscernible extent.

This pump design improves the flow conditions between the pump sections. Due to the tapering of the shaft section, the flow resistance at the choke points is reduced. Due to the increased cross section, the flow speed in the region of the shaft section is decreased, which reduces static pressure loss. The smooth contour reduces the danger of swirling. Both in combination decrease the danger of cavitation occurring so that less of an increase in pressure is needed. The NPSH value of the pump is accordingly improved in comparison to the prior art. These achieved advantages outweigh the disadvantage with regards to the stability of the second impeller that results from the constriction and that initially makes the concept of a shaft constriction unappealing.

The flow path between the shaft sections is improved when the thinnest point of the shaft section is arranged in the second chamber.

According to a development, it is proposed to arrange the thinnest point of the shaft section in the opening. This produces a greater passage cross-section for fluid so that a large amount of fluid with a reduced flow speed and a strongly reduced number of swirls can flow between the pump stages.

The pump possesses a drive with a simple design when, according to another development, the first impeller and second impeller are overhung together.

According to another development, the shaft section is formed on the second impeller. As additional advantages, this makes the pump easy to produce and makes it possible to create a modular system of self-priming and non-self-priming pumps in which the different types have many equivalent parts.

Another development refers to the connection of the impellers. The shaft section is accordingly shaped so that it accommodates a threaded section of a drive shaft bearing the first impeller. This is an advantageously simple design that moreover enhances the advantages of a modular system.

One development of the pump in the context of this invention is that the first impeller has a first clamping surface that interacts with the second clamping surface formed on the second impeller, and a clamping force is introduced into the first impeller via the clamping surfaces to clamp the first impeller on a cone frustum that is formed on a driveshaft that bears the first impeller. This is a simple, economical design that advantageously causes the two impellers to be attached at the same time.

According to a subsequent development, it is proposed that the second impeller comprises a helical blade arranged on a cylinder. This means that the second impeller is easy and economical to produce, for example according to DE 20 2004 013 752 U1.

The pumping effect of the pump stage with the at least one helical blade can be further improved when the blade has an extension on its end facing the shaft section.

For the aforementioned uses in a hygienic to aseptic context, it is advantageous to design the pump so that the first impeller is a part of a normally priming centrifugal pump.

Also in light of the use and in combination with a centrifugal pump stage, an advantageous embodiment is a pump in which the second impeller is part of a liquid ring pump stage.

The swirling of the pumped fluid is advantageously reduced, and the occurrence of cavitation is also reduced when the pump is developed so that an end face formed on the second impeller on the side facing the shaft section smoothly transitions into the shaft section.

The invention will be further explained, and details of the effects and advantages will be described with reference to an exemplary embodiment and its developments.

DETAILED DESCRIPTION

Figure 1:
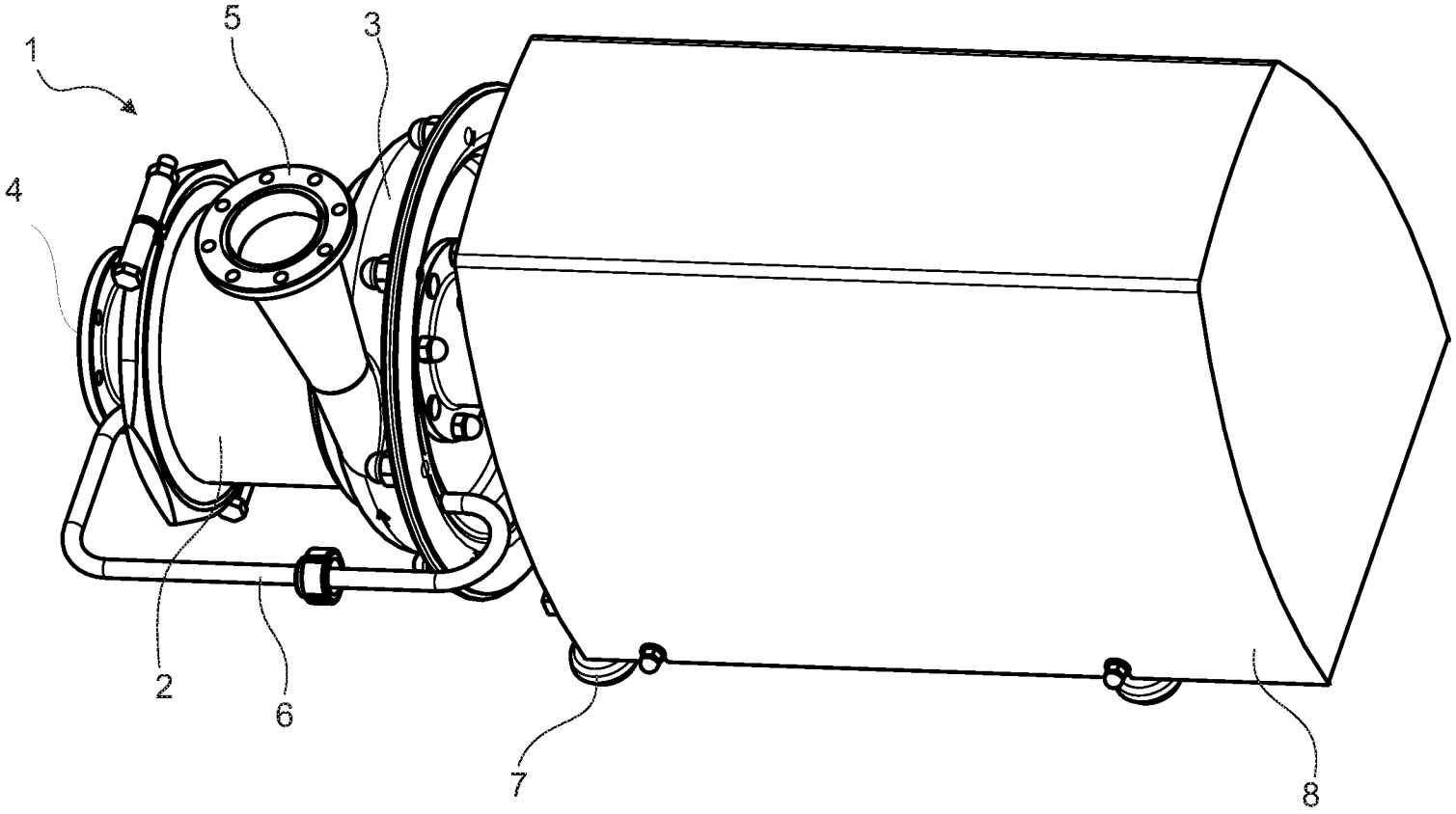
FIG. 1 shows a perspective view of a self-priming rotary pump.

FIG. 1 shows a self-priming rotary pump 1 in a perspective representation. This rotary pump 1 comprises a liquid ring pump stage 2 and a normally priming centrifugal pump 3. The liquid ring pump stage 2 is assigned an inlet 4 of the self-priming rotary pump 1. Fluid, especially liquid to which gas may be added, enters through the inlet 4 of the rotary pump 1 and initially passes into the liquid ring pump stage 2. Then the fluid is transferred to the centrifugal pump 3. The fluid ejected from there leaves the self-priming rotary pump 1 through the outlet 5. A return line 6 branches from the centrifugal pump 3. The fluid flows through this return line 6 from the rotary pump 1 back into the liquid ring pump stage 2 and is available there to form the liquid ring even when the rotary pump 1 is starting.

The self-priming rotary pump 1 rests on feet 7 and possesses a cover 8 under which drive and control means are located, wherein the pumping effect of the self-priming rotary pump 1 can be controlled using these drive and control means.

Figure 2:
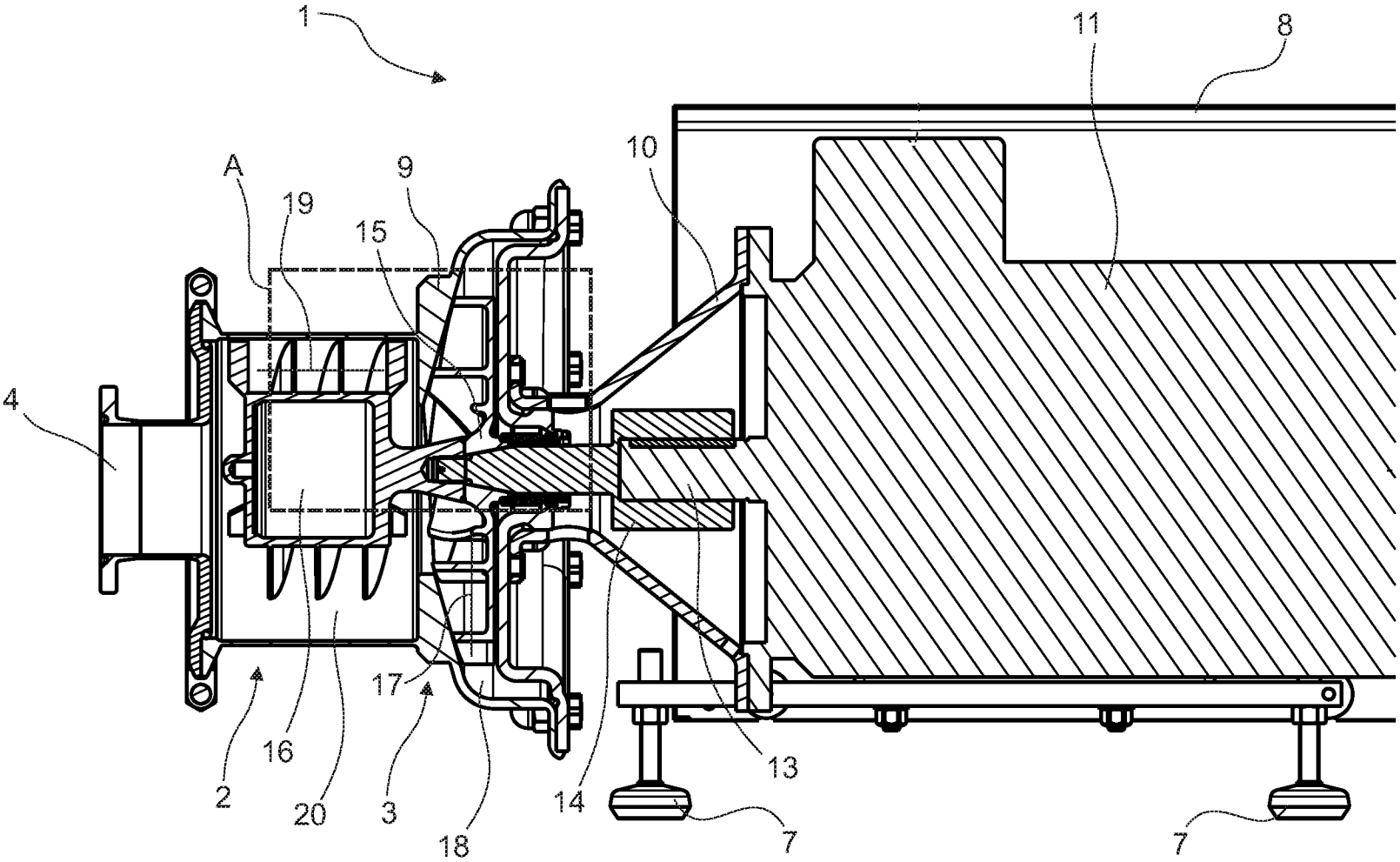
FIG. 2 shows a longitudinal section of a self-priming rotary pump.

FIG. 2 shows a longitudinal section of a self-priming rotary pump 1.

A housing 9 comprising a plurality of individual parts accommodates the liquid ring pump stage 2 and the normally priming centrifugal pump 3. The housing 9 is borne by a lantern 10 that produces a connection to a motor 11. This motor 11 is typically designed as an electric motor and is actuated by control electronics. The motor 11 and control electronics are arranged under the cover 8 and are borne by the feet 7.

The motor 11 possesses a motor shaft 13 by means of which a driveshaft 14 is releasably connected to the motor 11 for conjoint rotation. This driveshaft 14 bears a first impeller 15 and a second impeller 16. The impellers 15 and 16 are jointly overhung by means of the motor shaft 13 and driveshaft 14 and are rotatably supported by the bearings of the motor shaft 13.

The first impeller 15 is a part of the normally priming centrifugal pump 3 and has a first pump section 17. This is arranged in a first chamber 18. When the driveshaft 14 rotates, fluid flows into the region of a rotational axis of the driveshaft 14 and hence the first impeller 15 is moved by the first pump section 17 radially to the outside in a peripheral direction at that location and pressurized.

The second impeller 16 is part of the liquid ring pump stage 2 and comprises a second pump section 19. This second pump section 19 is arranged in a second chamber 20 and is designed so that a liquid ring is generated therein when the driveshaft 14 rotates, wherein an axis of symmetry of the liquid ring is caused to move radially to the rotational axis of the driveshaft 14. By means of the liquid ring and the second impeller 16 arranged eccentric thereto, an underpressure arises within the liquid ring pump stage 2 that causes the fluid to be drawn through the inlet 4.

Figure 3:
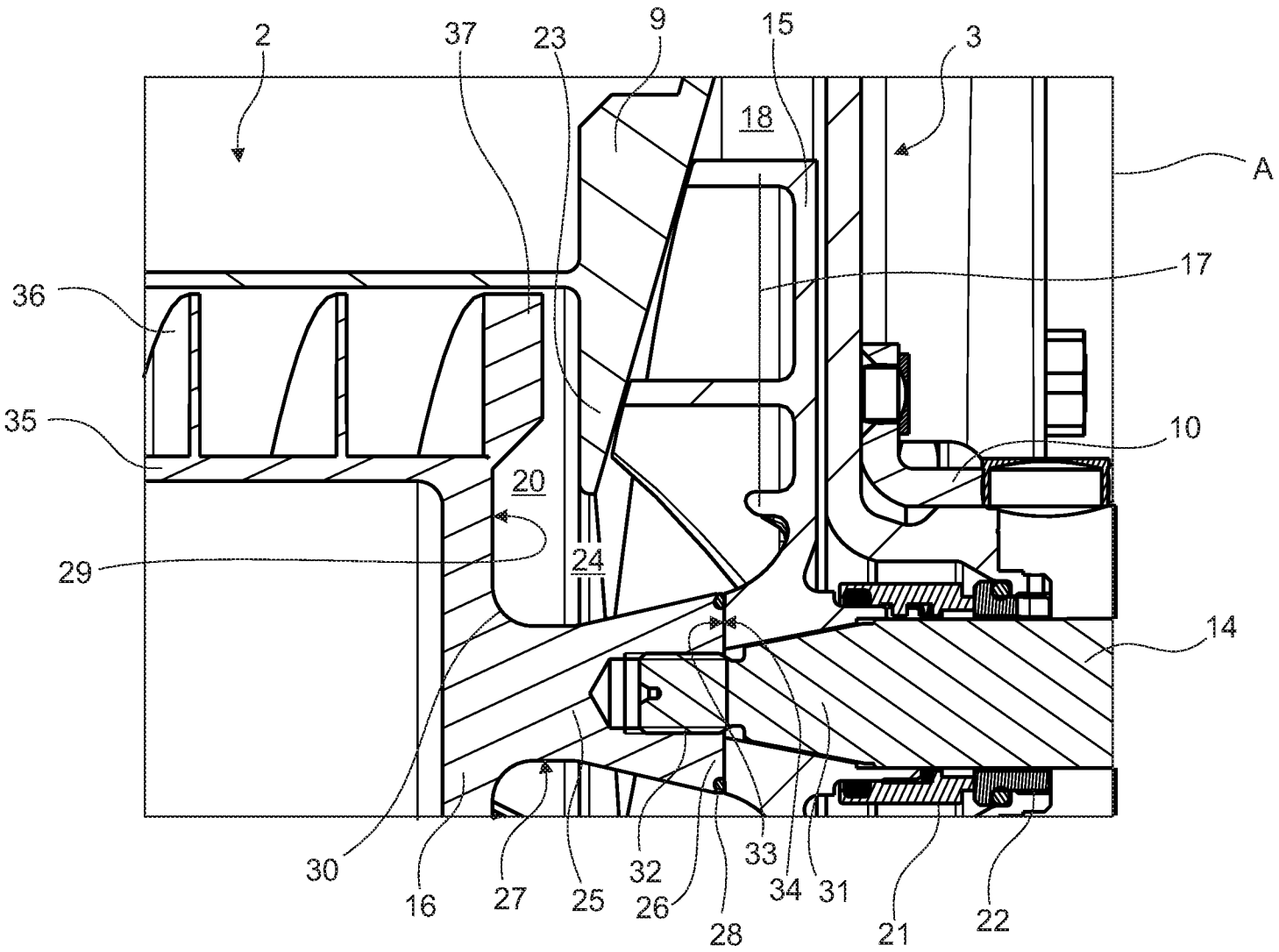
FIG. 3 shows a section of detail view A of FIG. 2.

The detail view A is depicted enlarged in FIG. 3 and shows a section of the impellers and the region of the connection of the two impellers with each other.

The driveshaft 14 passes through the housing 9 in the region in which the housing 9 and the lantern 10 are connected to each other. The lantern 10 surrounds the driveshaft 14. A sliding ring seal seals the interior of the housing 9 against the atmosphere. This sliding ring seal surrounds a rotating sliding ring 21 that is arranged to rotate conjointly with the driveshaft 14. The rotating sliding ring 21 is in sliding contact with a fixed sliding ring 22 that is installed in the housing 9 such that it does not rotate conjointly. A development of the sliding ring seal is a ringed design according to DE 203 16 570 U1.

The first chamber 18 is separated from the second chamber 20 by a housing wall 23. An opening 24 through which a shaft section 25 passes is provided in this housing wall 23.

The shaft section 25 in this example is designed as part of the second impeller 16 and comprises a shaft end 26 and a constriction 27. The shaft end 26 is in mechanical contact with the first impeller 15. The transition point between the first impeller 15 and shaft section 25 is sealed with the assistance of a seal 28. The seal 28 is designed as a toroidal sealing ring that is accommodated in an adapted contour such that there is no remaining gap between it and the seat. This is advantageous for hygienic use because contamination deposits are prevented.

The shaft section 25 is formed between the constriction 27 and shaft end 26 and tapers from the shaft end 26 toward the constriction 27. A diameter of the shaft section 25 decreases from the transition to the first impeller 15 toward the constriction 27. At the same time, the second impeller 16 and the shaft section 25 have a smooth contour between the constriction 27 and the first pump section 17. The constriction 27 together with the smooth contour cause a more even distribution and reduction of the flow speed in this region of the rotary pump. In particular, peaks in the flow speed are reduced to largely be avoided; the speed is reduced over the entire cross-section. This reduces the NPSH value.

The smooth contour exists in a mathematical sense when the curve of intersection in FIG. 3 follows a curve with a steady slope. This means that kinks, steps or ledges are avoided to the extent technically feasible. In the context of this invention, "smooth" also exists when the seal 28 possesses an exposed section that interrupts the surface of the shaft section 25 and first impeller 15 and is partially exposed with a bulge. So long as a predominantly laminar flow remains able to be formed along the surface of the shaft section 25 and first impeller 15, a sufficiently smooth contour exists.

A further improvement of the flow path exists when, as in the depicted example, an end face 29 of the second impeller transitions with a fillet 30 and hence with a smooth contour into the shaft section 25. If the shaft section 25 is designed as a single part with the second impeller 16, the fillet 30 can be produced particularly easily and smoothly.

The shaft section in the constriction 27 reaches its thinnest point preferably in the second chamber 20 and/or in the opening 24 in the housing wall 23. The constriction 27 can, as depicted, possess an expansion in the longitudinal direction of the shaft section. Given this placement and possible expansion of the constriction 27, it is possible to keep the opening 24 small with a large flow passage so that the functions of the liquid ring pump stage 2 and normally priming centrifugal pump 3 are not impaired despite increasing the cross sectional area.

The exemplary embodiment shows a connection of the driveshaft 14 to the first impeller 15 and second impeller 16 that is highly suitable for absorbing the forces resulting from the overhang and thereby enables high precision and a small gap to the housing 9.

On its end facing away from the motor shaft 13, the driveshaft 14 has a cone frustum 31 that terminates in a cylindrical threaded section 32. This threaded section 32 is accommodated in a thread in the shaft section 25 to form a screwed connection. The first impeller 15 has a first clamping surface 33 that can be brought into mechanical contact with a second clamping surface 34 formed on the shaft section 25. Producing the screwed connection with the participation of the threaded section 32 generates clamping forces that are introduced by the second impeller 16 via the first clamping surface 33 and the second clamping surface 34 into the first impeller 15 and bring about clamping on the cone frustum 31.

The second impeller has a cylinder 35 as a main body. At least one helical peripheral blade 36 is provided thereupon. This blade 36 serves to generate and maintain a liquid ring in the second chamber 20 and to convey the gas phase through the second chamber 20 in a helical manner. This at least one blade 36 forms the second pump section 19. On its end, the blade can have an extension 37 that extends in an axial direction beyond the end face 29. This runs within the gap that exists between the end of the blade 36 and the housing wall 23 where it improves the formation of the liquid ring.

Figure 4:
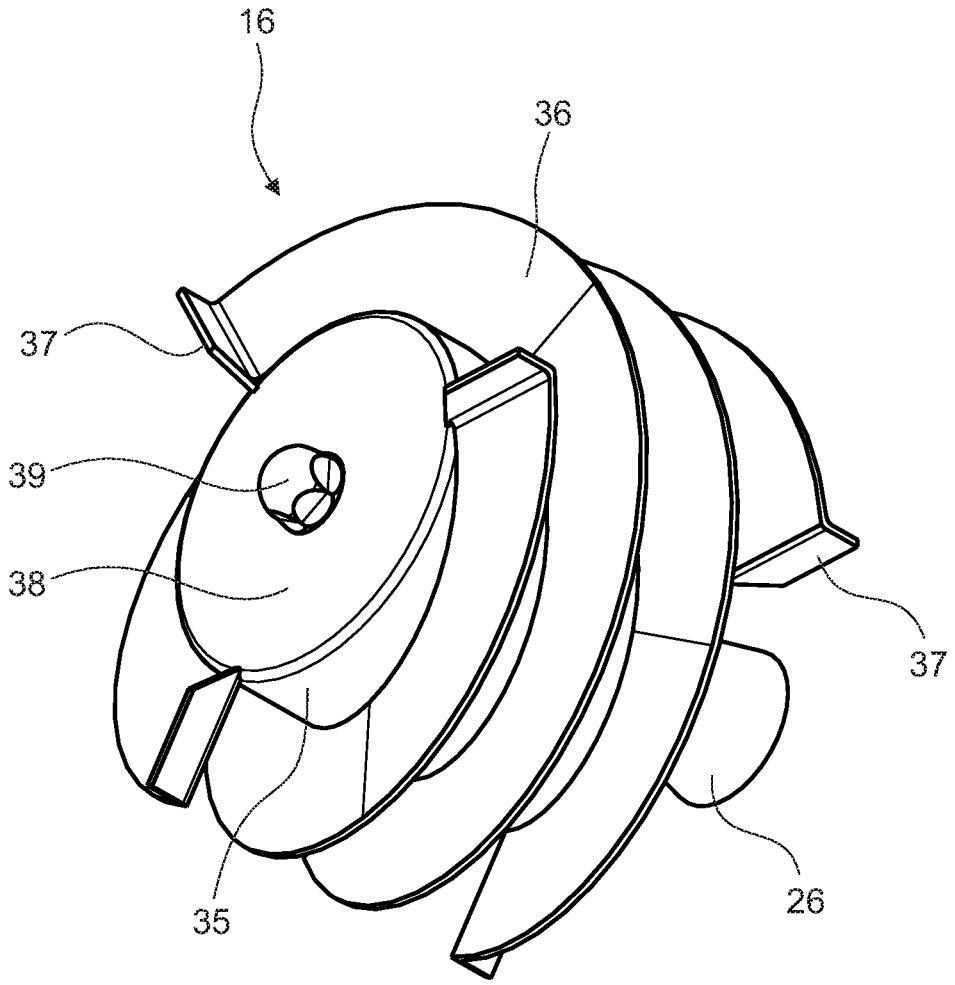
FIG. 4 shows a perspective representation of the second impeller.

FIG. 4 shows a perspective view of the second impeller 16. The second impeller 16 in this figure has three blades 36, and each of the blades has extensions 37 on its end that are oriented in an axial direction. Extensions 37 are provided both on the side facing the inlet 4, as well as on the side of the shaft section 25. The cylinder 35 that is sealed by an end plate 38 possesses a pullout 39 with arranged key surfaces by means of which the second impeller 16 can be screwed onto the threaded section 32.

A list of reference numbers shown in the drawings is as follows:

1 Self-priming rotary pump
2 Liquid ring pump stage
3 Normally-priming centrifugal pump
4 Inlet
5 Outlet
6 Return line
7 Feet
8 Cover
9 Housing
10 Lantern
11 Motor
13 Motor shaft
14 Driveshaft
15 First impeller
16 Second impeller
17 First pump section
18 First chamber
19 Second pump section
20 Second chamber
21 Rotating slide ring
22 Stationary slide ring
23 Housing wall
24 Opening
25 Shaft section
26 Shaft end
27 Constriction
28 Shaft seal
29 End surface
30 Fillet
31 Cone frustum
32 Threaded section
33 First clamping surface
34 Second clamping surface
35 Cylinder
36 Blade
37 Extension
38 End plate
39 Pullout
A Detail view

The invention claimed is:

1. A self-priming pump, comprising:
a housing;
an inlet in fluid connection with the housing;
an outlet in fluid connection with the housing;
a first impeller having a first pump section that is arranged in a first chamber within the housing;
a second impeller with a second pump section that is arranged in a second chamber within the housing; and
a shaft section provided between the first pump section and the second pump section, wherein:
the housing includes a housing wall that extends inwardly toward the shaft section to define the first chamber and the second chamber such that the first pump section of the first impeller faces a first surface of the housing wall and a radially-extending surface of the second impeller faces a second surface of the housing wall that opposes the first surface of the housing wall,
the shaft section comprises a constriction about an outer peripheral surface of the shaft section and a shaft end, penetrates an opening in the housing wall, and is formed to taper from the shaft end toward the constriction, and
the first impeller and the shaft section have a smooth contour between the constriction and the first pump section.

2. The self-priming pump according to claim 1, wherein a thinnest point of the constriction is arranged in the second chamber.

3. The self-priming pump according to claim 1, wherein a thinnest point of the constriction is arranged in the opening.

4. The self-priming pump according to claim 1, wherein the first impeller and the second impeller are jointly overhung.

5. The self-priming pump according to claim 1, wherein the shaft section is formed as part of the second impeller and extends from the radially-extending surface of the second impeller.

6. The self-priming pump according to claim 1, wherein the shaft section accommodates a threaded section of a driveshaft that bears the first impeller.

7. The self-priming pump according to claim 1, wherein the first impeller has a first clamping surface that interacts with a second clamping surface formed on the second impeller, and a clamping force is introduced into the first impeller via the first clamping surface and the second clamping surface to clamp the first impeller on a cone frustum that is formed on a driveshaft that bears the first impeller.

8. The self-priming pump according to claim 1, wherein the second impeller comprises a helical blade arranged on a cylinder, the cylinder forming an end face portion of the radially-extending surface of the second impeller.

9. The self-priming pump according to claim 8, wherein the helical blade has an extension on its end, the extension facing the shaft section on one side and the extension, on another side, extending closer to the housing wall than the end face portion.

10. The self-priming pump according to claim 1, wherein the first impeller is part of a normally priming centrifugal pump.

11. The self-priming pump according to claim 1, wherein the second impeller is part of a liquid ring pump stage.

12. A self-priming pump, comprising:

a housing;

an inlet;

an outlet;

a first impeller having a first pump section that is arranged in a first chamber;

a second impeller with a second pump section that is arranged in a second chamber;

a shaft section provided between the first pump section and the second pump section; and an end face formed on a side of the second impeller facing the shaft section, wherein:

the end face transitions smoothly into the shaft section, the shaft section comprises a shaft end, penetrates an opening in a housing wall, and is formed to taper from the shaft end toward a constriction, and the first impeller and shaft section has a smooth contour between the constriction and first pump section.

13. The self-priming pump according to claim 2, wherein the first impeller and the second impeller are jointly overhung.

14. The self-priming pump according to claim 2, wherein the shaft section is formed on the second impeller.

15. The self-priming pump according to claim 2, wherein the shaft section accommodates a threaded section of a driveshaft that bears the first impeller.

16. The self-priming pump according to claim 2, wherein the first impeller has a first clamping surface that interacts with a second clamping surface formed on the second impeller, and a clamping force is introduced into the first impeller via the first clamping surface and the second clamping surface to clamp the first impeller on a cone frustum that is formed on a driveshaft that bears the first impeller.

17. The self-priming pump according to claim 12, wherein the second impeller comprises a helical blade arranged on a cylinder, the cylinder forming an end face portion of a radially-extending surface of the second impeller, and the helical blade has an extension on each of its ends that are oriented in an axial direction.

18. The self-priming pump according to claim 8, wherein the end face portion transitions smoothly into the shaft section.

19. The self-priming pump according to claim 1, wherein the second impeller comprises a helical blade arranged on an axially-extending outer surface of a cylinder, the helical blade having an extension on an end that extends axially.

20. The self-priming pump according to claim 1, wherein the first impeller is part of a normally priming centrifugal pump, the second impeller is part of a liquid ring pump stage, and the inlet is an inlet of the liquid ring pump stage, the self-priming pump further comprising:

a return line that connects an overpressure region of the normally priming centrifugal pump to the inlet of the liquid ring pump stage.

* * * * *